US007887671B2

(12) United States Patent
Snekkenes et al.

(10) Patent No.: US 7,887,671 B2
(45) Date of Patent: Feb. 15, 2011

(54) METHOD FOR DILUTION OF CELLULOSE PULP

(75) Inventors: Vidar Snekkenes, Karlstad (SE); Lennart Gustavsson, Karlstad (SE); Jonas Saetherasen, Karlstad (SE); Goran Olsson, Karlstad (SE)

(73) Assignee: GLV Finance Hungary Kft., Mansbach (LU)

( * ) Notice: Subject to any disclaimer, the term of this patent is extended or adjusted under 35 U.S.C. 154(b) by 822 days.

(21) Appl. No.: 10/599,092

(22) PCT Filed: Mar. 9, 2005

(86) PCT No.: PCT/US2005/000350

§ 371 (c)(1),
(2), (4) Date: Aug. 1, 2007

(87) PCT Pub. No.: WO2005/098127

PCT Pub. Date: Oct. 20, 2005

(65) Prior Publication Data

US 2008/0000600 A1 Jan. 3, 2008

(30) Foreign Application Priority Data

Apr. 7, 2004 (SE) ..... 0400940

(51) Int. Cl.
*D21F 1/74* (2006.01)
*D21C 9/18* (2006.01)
*D21C 9/06* (2006.01)

(52) U.S. Cl. ..... 162/18; 162/52; 162/56; 162/60; 241/21; 241/24.19; 210/770; 210/772; 210/784

(58) Field of Classification Search ..... 162/17–19, 162/23, 52, 55–56, 60; 241/21, 24.1, 24.11, 241/24.19, 28, 29; 210/767, 772, 784, 402; 209/132, 155
See application file for complete search history.

(56) References Cited

U.S. PATENT DOCUMENTS 4,207,141 A * 6/1980 Seymour ..... 162/49

(Continued)

FOREIGN PATENT DOCUMENTS

EP 0627029 B1 1/2000

(Continued)

OTHER PUBLICATIONS

Carlston W. Dence, "Pulp Bleaching, Principles and Practice", Tappi Press, 1996; p. 336, col. 2, last line; p. 337, Figure 11.

*Primary Examiner*—José A Fortuna

(57) ABSTRACT

The method and a device is for the dilution of dewatered cellulose pulp that maintains a consistency of 20-30% or greater. By shredding of the pulp to a finely divided dry-granulate, dilution to a homogeneous consistency in the medium consistency range can take place exclusively through hydrodynamic effects from the addition of dilution fluid. The dilution fluid is added to granulate at a position at which granulate is in free fall in a standpipe and above a level $Liq_{LEV}$ of diluted pulp in the standpipe. A number of nozzles are arranged around the periphery of the stand pipe, directed in towards the centre of the stand pipe, obliquely downwards in the direction of fall of the granulate. It is possible through this simplified procedure to avoid completely the conventional dilution screws, and this reduces the investment costs and operating costs, while at the same time unnecessary mechanical influence of the pulp fibres can be avoided.

6 Claims, 3 Drawing Sheets

U.S. PATENT DOCUMENTS

| | | | | |
|---|---|---|---|---|
| 4,596,631 | A * | 6/1986 | Prough et al. | 162/52 |
| 4,705,600 | A * | 11/1987 | Jacobsen | 162/19 |
| 4,827,741 | A * | 5/1989 | Luthi | 68/43 |
| 4,840,704 | A * | 6/1989 | Seymour | 162/49 |
| 4,922,989 | A * | 5/1990 | Backlund et al. | 162/24 |
| 5,122,229 | A * | 6/1992 | Seifert | 162/60 |
| 5,133,832 | A * | 7/1992 | Gilkey | 162/4 |
| 6,120,646 | A * | 9/2000 | Snekkenes et al. | 162/236 |
| 6,767,432 | B1 * | 7/2004 | Laine et al. | 162/243 |
| 7,229,527 | B2 * | 6/2007 | Laine et al. | 162/56 |
| 7,252,739 | B2 * | 8/2007 | Brottgardh et al. | 162/18 |
| 2002/0124977 | A1 * | 9/2002 | Brottgardh et al. | 162/56 |
| 2004/0084160 | A1 * | 5/2004 | Laine et al. | 162/56 |
| 2005/0126725 | A1 * | 6/2005 | Brottgardh et al. | 162/18 |
| 2005/0224198 | A1 * | 10/2005 | Snekkenes et al. | 162/17 |
| 2006/0037723 | A1 * | 2/2006 | Gustavsson et al. | 162/52 |
| 2008/0000600 | A1 * | 1/2008 | Snekkenes et al. | 162/157.6 |

FOREIGN PATENT DOCUMENTS

| | | | |
|---|---|---|---|
| EP | 1584743 | A1 * | 10/2005 |
| JP | 2005299073 | A * | 10/2005 |
| WO | WO 3078727 | A1 * | 9/2003 |
| WO | WO 2005064078 | A1 * | 7/2005 |

* cited by examiner

METHOD FOR DILUTION OF CELLULOSE PULP

PRIOR APPLICATION

This application is a U.S. national phase application based on International Application No. PCT/SE2005/000350, filed 9 Mar. 2005, claiming priority from Swedish Patent Application No. 0400940-3, filed 7 Apr. 2004.

THE PRIOR ART

In association with either one of the bleaching and the delignification of cellulose pulp in bleaching lines, the pulp passes between different treatment steps in which the pulp is subjected to bleaching or the delignifying effect of various treatment chemicals. The treatment typically alternates between alkaline and acidic treatment steps in which typical sequences may be of ECF type (elemental chlorine-free, Cl, in which chlorine dioxide may be used) such as O-D-E-D-E-D, O-D-PO or sequences of TCF-type (totally chlorine-free) such as O-Z-E-P. Other bleaching steps, such as Pa steps and H steps may be used.

The treatment steps may take place either at medium consistency (8-16%) or at high consistency (≧20-30%), but it is vitally important to wash out after each treatment step degradation products and lignin precipitated during the treatment step and to reduce to a minimum the remaining fraction of fluid, since the latter will otherwise lead to an increased requirement for pH-adjusting chemicals for the subsequent treatment steps and transfer of precipitated lignin and other degradation products, which subsequent step generally takes place at a completely different pH.

Simple vacuum filters with dewatering drums that are partially (typically 20%-40% of the drum) immersed in the pulp suspension that is to be dewatered were used in certain older types of washing step after a bleaching step or a delignification step. In these vacuum filters, a bed of pulp forms spontaneously against the outer surface of the drum under the influence of a negative pressure in the interior of the drum, and the pulp bed is drawn up from the pulp suspension by the rotation of the drum and is scraped off with a scraper on the side of the drum that is moving downwards. A consistency higher than 8-14% is generally never achieved for the pulp bed that has been dewatered, due to the limited degree of dewatering that is achieved, and the dewatered pulp that is scraped of can be readily formed to a slurry with a low consistency again in a subsequent collecting trough. The technique used here is a lower degree of dewatering followed by slurry formation with a cleaner filtrate, and this takes place in a series of vacuum filters in order to achieve the required washing effect. For this reason, it is attempted to achieve as high a degree of dewatering as possible before the dewatered pulp is again formed to a slurry with cleaner filtrate before the subsequent treatment stage.

A dominating washing machine on the market for bleaching lines is the conventional dewatering press, or thickening press, in which pulp is applied to at least one outer surface of the dewatering drum and subsequently passes a nip between the drums and acquires a consistency of 20-30% or greater after the nip. A practical upper limit lies at 35-40%, where a higher degree of dryness cannot be achieved without affecting the strength properties of the fibres negatively. A representative washing press of this type is disclosed in the U.S. Pat. No. 6,521,094.

The dewatered mat of cellulose pulp that is fed out from the washing machine's nip must first be shredded due to the high degree of dewatering, which shredding takes place in a shredder screw.

The purpose of the shredder screw has been exclusively to break up the mat of dewatered cellulose pulp and feed it onwards to equipment in which the cellulose pulp is rediluted to a consistency that makes it possible to pump it onwards to the next treatment step.

The redilution thus preferably takes place in association with adjustment of the pH, which after an alkaline wash normally involves the addition of powerful acidifiers, or the addition of acidic return water/filtrate from subsequent process steps, before the subsequent acidic treatment step. These acidic conditions have involved the dilution in general being held well separated from the previous alkaline wash as well as the associated shredder screw, since the alkaline wash can be built from simpler material than that which is normally required for washing machines that resist acidic conditions. Acidic conditions require material that can resist acids, and this is significantly more expensive that other material.

The pulp on exit from the shredder screw has a very high level of dryness, a consistency of 20-30% or greater, and this means that redilution has been carried out in all installed plants in at least one separate dilution screw arranged after the shredder screw, where the dilution fluid is added during intensive agitation from the dilution screw in order to achieve a suitable homogenous consistency that makes pumping onwards to the next treatment stage possible. The diluted pulp that is achieved after the dilution screw is fed to a stand pipe in the bottom of which a pump is arranged.

A second alternative for washing is the use of a dewatering screw, in which the cellulose pulp is first diluted and subsequently dewatered in a dewatering screw (of the Thune type or Sudor press type) to a level of dryness that considerably exceeds 20-30%. In this way, what is known as "wash-by-dilution" is achieved. A compacted and well-consolidated dewatered pulp is obtained at the exit from the dewatering screw also in this case. A redilution has been used also in this case after the dewatering screw, with the addition of dilution fluid during intensive agitation from a dilution screw.

The very high consistency of the pulp after the dewatering press or the dewatering screw has given rise to the belief that dilution to a homogenous medium consistency cannot be achieved unless dilution occurs under the influence of intensive agitation from the dilution screw. A consistency of the pulp of 20-30% or greater is experienced as dry and compacted. It can be mentioned for the sake of comparison that medium-consistency pulp is so compact that it is just about possible to walk on this pulp, when it is at the upper part of the consistency range.

The use of a dilution screw at this position, however, increases the requirement for energy, it increases investment costs, it raises the requirement for maintenance and it involves a further mechanical treatment of the pulp which has a negative influence on the strength properties of the pulp.

AIM AND PURPOSE OF THE INVENTION

The present invention is intended to remove the above-mentioned disadvantages and is based on the surprising insight that even if the pulp has been dewatered to give a very high consistency, 20-30% or more, no mechanical agitation at all is required during the dilution provided that the pulp bed has been shredded to give small granules of a suitable size, and provided that the dilution fluid is added evenly over a flow of the freely falling granulated pulp.

It has surprisingly turned out to be the case that the granulated pulp demonstrates the properties of a sponge, despite its high consistency, and that, provided the dilution fluid is added evenly to a flow of non-tightly packed granulated pulp in free-fall, a primary homogenised dilution of the pulp takes place that is fully adequate such that it can subsequently be pumped or led onwards to the following bleaching stage or treatment stage.

It is sufficient in laboratory experiments with small quantities of well-granulated pulp with a consistency around 30-35% to pour the required amount of fluid to obtain the required consistency into a container with granulated and non-compressed pulp, and the complete mixture has been homogenised to an even consistency after the addition of the fluid totally without mechanical agitation. Observation of the granulated pulp has shown that there lie cavities between the granules, and the fluid rapidly penetrates between the granules through the complete volume of the granules, after which the granules absorb the fluid as sponges.

This primarily homogenised pulp is fully adequate to be pumped with a subsequent pump, in which a secondary or complementary homogenisation takes place, and these together ensure that the same degree of homogenisation of the pulp can be achieved for the subsequent treatment stage completely without mechanical agitation from a dilution screw.

The principal aim of the invention is thus to redilute pulp from a high consistency of 20-30% or higher without the use of a dilution screw and without intensive mechanical agitation, which reduces losses in the strength of the pulp.

A second aim is to reduce operating costs and maintenance costs for the process equipment in the redilution, since no operation of dilution screw is necessary.

A further aim is to reduce the investment cost of the process equipment. A reduction of both operating costs and investment costs in the process equipment entails a reduction in the cost of manufacturing bleached pulp to an equivalent degree, and this saving is multiplied by the number of washing machines that are used in the bleaching line. No less than six washing machines are included in an O-D-E-D-E-D sequence, and thus the reduction in costs can be significant.

Approximately 50 kW is required solely for the operation of one dilution screw, and the investment cost is approximately SEK 500,000 (depending to a certain extent on requirements on materials, i.e. whether it needs to be acid-resistant or not).

The operating costs per year in an O-D-E-D-E-D bleaching line will be:

6*50 kW*SEK 0.20 (the price for an operator in Sweden)*24 hours*350 days (the number of operating days per year, excluding stoppages)=SEK 500,000 SEK per year;

and the investment cost will be:

6*SEK 500,000=SEK 3,000,000.

This investment cost at an interest rate of 5% corresponds to an annual expense of SEK 150,000.

In summary, implementation of the invention involves a total annual saving that approaches SEK 650,000-1,000,000 SEK including maintenance costs and building space (frameworks, etc.) in a bleaching line with a capacity of 1,000 tonnes per day.

Furthermore, availability of the mill increases since six machines can be removed, each of which has an MTBF (mean time between failure).

A further aim is to remove a treatment step between the washing machine and the subsequent pumping, which makes possible a more compact mill and opportunities to place the washing machines at a lower height over the ground in the mill. The washing machines are normally placed at a great height over the ground, and the pulp falls downwards after being washed in the washing machine while it passes through various conditioning steps. If one of these conditioning steps (such as the dilution screw) becomes unnecessary, the building height can be reduced, which in turn gives a saving.

DETAILED DESCRIPTION OF PREFERRED EMBODIMENTS

Figure 1:
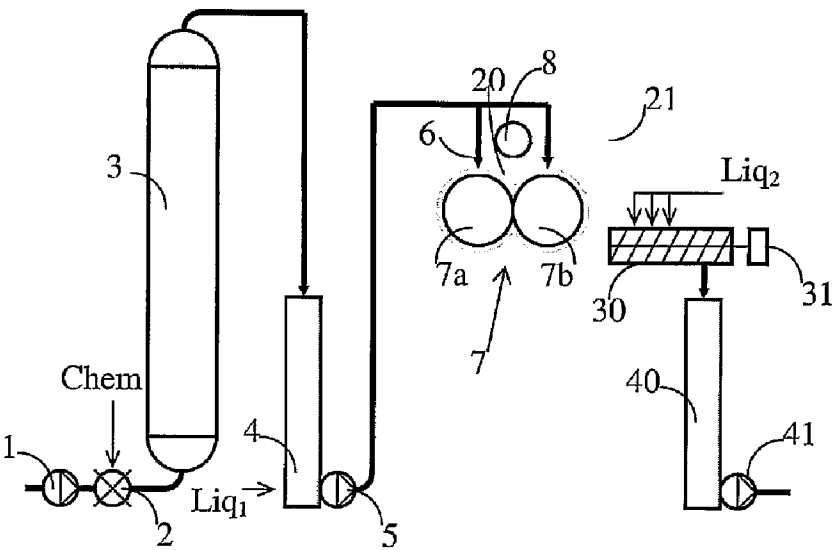
Fig.1 Prior Art
FIG. 1 shows a typical treatment step for the pulp in a reactor with a subsequent washing press according to the prior art.

FIG. 1 shows a conventional treatment step for cellulose pulp, hereafter denoted "pulp". The pulp is fed by the pump 1 to a mixer 2 in which necessary treatment chemicals are added. These treatment chemicals can be, for example, oxygen gas, ozone, chlorine dioxide, chlorine, peroxide, pure acid or a suitable alkali for an extraction step, or a mixture of these, and possibly other chemical or additives such as a chelating agent. The pulp is transported after the addition of the necessary chemicals by the mixer 2 to a reactor system 3, here shown in the form of a single-vessel tower 3 of upwards flow. The reactor system can, however, be constituted by simple pipes or by one or several reactors in series, and possibly with the batchwise addition of chemicals between the towers in those cases in which the bleaching processes are compatible and do not require washing between the towers.

The treated pulp is fed after treatment in the reactor system 3 to a pulp chute/stand pipe 4, which establishes the buffer volume and static pressure required, to a pump 5 arranged at the bottom of the pulp chute.

The pulp is fed from the pump 5 to a washing machine 7, shown here in the form of a washing press with two drums 7*a*, 7*b*. The pulp is applied to the drums, here at the 12 o'clock position, and is led by convergent pulp collectors during the addition of washing fluid (not shown in the drawing) to a final dewatering nip between the drums, from where a mat of dewatered pulp is fed upwards to a shredder screw 8.

The drums in FIG. 1 rotate in opposite directions and the pulp mat is dewatered through the outer surface of the drum while the pulp is lead approximately 270° around the circumference of the drum to the nip.

The washing press may be preferably equivalent to that revealed by the U.S. Pat. No. 6,521,094. Any other type of dewatering press or washing press, however, having a drum or drums, may be used, in which a consistency of 20-30% or higher is achieved, for example a washing press with a single dewatering drum and an opposing roller, or other types of washing press with two dewatering drums.

The pulp is fed upwards from the nip in the form of a dewatered and compressed mat 20 of cellulose pulp that has been consolidated into large pieces to a shredder screw 8, the shredding axis of which is arranged to be essentially parallel to the axes of rotation of the drums. A small oblique mounting of a maximum of 5-10° may, for example, be present if a conical shredder screw is used, where the mat is fed to an inlet slit in the outer casing of a conical shredder screw, where the inlet slit lies parallel with the axes of the drums. The fragmented pulp is led after this shredder screw 8 out from an outlet in the casing of the shredder screw in the flow 21 to a dilution screw 30 that is driven by a motor 31. The dilution screw exposes the pulp to continuous tumbling during the addition of dilution fluid Liq2, and the pulp is subsequently fed to a stand pipe 40 at its finally conditioned consistency. The pulp can subsequently be pumped from the stand pipe 40 to the next treatment step of similar type in the bleaching line.

Figure 2:
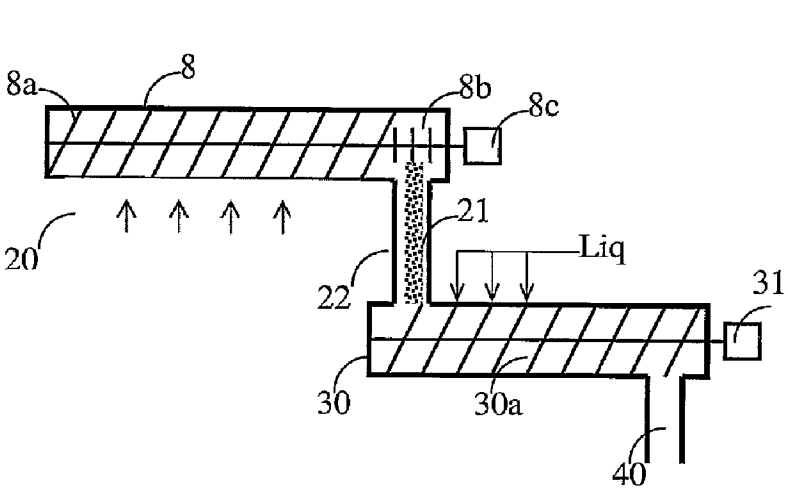
Fig.2 Prior Art
FIG. 2 shows part of the system in FIG. 1 (prior art)

FIG. 2 shows another view of a part of the same process in which the shredder screw 8 is oriented in the same direction as the dilution screw 30. It can be seen more clearly here how the dewatered and compressed mat 20 of pulp that has been consolidated into large pieces is fed into the shredder screw 8. The shredder screw contains a threaded screw 8*a* that is driven by a motor 8*c*, and that may also be equipped with a number of beaters 8*b* at its outlet, which beaters further whip and break up the shredded pulp. The purpose of the shredder screw is primarily to break into smaller pieces the dewatered and compressed mat 20 of pulp that has been consolidated into large pieces, and it may sometimes be sufficient with one such shredder screw. The beaters 8*b* may be arranged on the same shaft as the shredder screw and they provide an extra fragmentation effect, but they are primarily used to hold the outlet from the shredder screw free from the formation of blockages.

The fragmented flow 21 of pulp particles is fed thereafter to fall under its own weight to the subsequent dilution screw 30.

Figure 3:
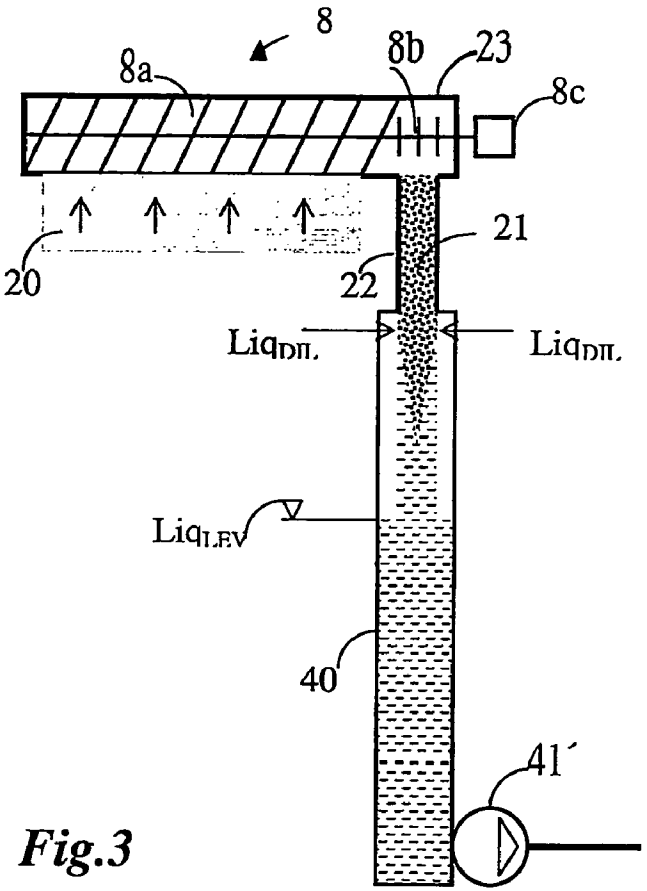
FIG. 3 shows a dilution system according to the invention.

FIG. 3 shows the dilution system according to the invention in a treatment step that is otherwise equivalent to that shown in FIG. 1. The dewatered web of pulp, which has a consistency of 20-30% or greater, is fed in this case in to the shredder screw 8 in the same way as shown in FIGS. 1 and 2. However, dilution occurs in the outlet from the shredder screw according to the invention in a significantly simplified manner. It is important that the web or mat 20 of pulp, which maintains a consistency of 20-30% or higher, is first fragmented by the shredder screw such that the mat 20 is granulated to a particle size that is normally distributed around a mean size that lies in the interval 5-40 mm. This is taken to denote that the fragmented pulp has a particle size that is normally distributed around a maximum size that is less than 40 mm, preferably less than 30 mm, and even more preferably less than 20 mm. It is appropriate that the normal distribution is distributed such that 90-95% of the fragmented pulp lies within ±5 mm of the maximum size, 40-30 or 20 mm, of the fragmented pulp.

The granulated pulp is then fed out from the outlet of the shredder screw in free fall into a stand pipe 22 connected to the outer casing of the shredder screw at its outlet. The dilution fluid LiqDIL is subsequently added under pressure into the stand pipe through a number of fluid jets preferably arranged around the periphery of the stand pipe and above a level LiqLEV of diluted cellulose pulp established in the stand pipe. Alternatively, some or all of the fluid jets may originate from a central pipe that is located in the flow of the fragmented pieces of pulp that are standing in free fall, and where the fluid jets are directed essentially radially outwards. A certain oblique adjustment may be established, but it is preferable that the jets are directed towards the freely falling flow with an angle of attack of 90°, or within the interval 90°±60° (=30°-155°), such that a certain minimum angle of attack is established. There may be so many fluid jets that an essentially continuous "fluid curtain" is established, or the dilution fluid may be injected into the flow of freely falling fragmented pulp through one or several slits. The important fact is that the dilution fluid is added to the flow at several points and at points at which the granulate is falling freely before it reaches the underlying surface of pulp that has been diluted to its final degree.

In the embodiment shown in FIG. 3, the upper connection 22 of the stand pipe to the outer casing of the shredder screw has a smaller diameter than the lower part 40' that lies below. The principle is that the pulp falls under the influence of gravity down through the parts 22, 40' of the stand pipe, and its lower part 40' is given a larger diameter in order to be able to establish a suitable buffer volume before the pumping with the pump 41' at a given level of pulp LiqLEV in the stand pipe 22, 40'.

The amount of dilution fluid LiqDIL added establishes a consistency of the cellulose pulp within the range of medium consistency 8-16%, which is a consistency that allows the pulp to be sent onwards using an MC pump. The amount of dilution fluid that is required in order to establish the consistency at which the pulp is subsequently pumped is constituted to more than 75-90% of the fluid that is added at the said nozzles arranged above the level/surface that has been established in the stand pipe. A certain amount of chemicals such as acidifiers/alkali or chelating agents may be added at the bottom of the stand pipe 22/40', but the principal dilution takes place with the dilution fluid above the pulp level established in the stand pipe.

The cellulose pulp at this medium consistency is fed by the pump 41 onwards from the lower end of the stand pipe to subsequent treatment steps for the cellulose pulp.

The dilution of the pulp from high consistency of 20-30% or greater at the upper part of the stand pipe to a medium consistency of 8-16% before the pumping from the lower part of the stand pipe takes place in this manner exclusively under the influence of the hydrodynamic effect from the addition of the dilution fluid through the said nozzles.

Figure 4:
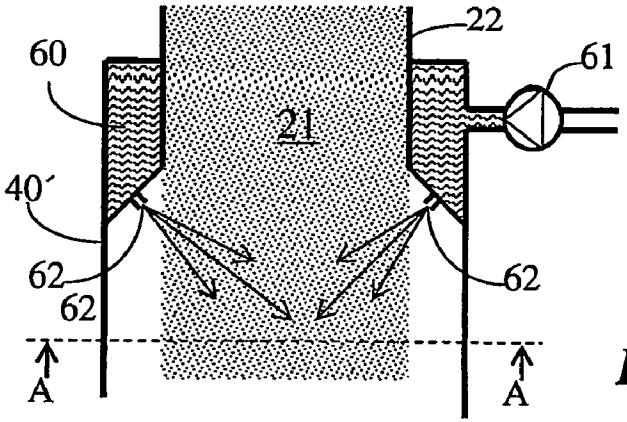
FIG. 4 shows a detail of FIG. 3.
Figure 5:
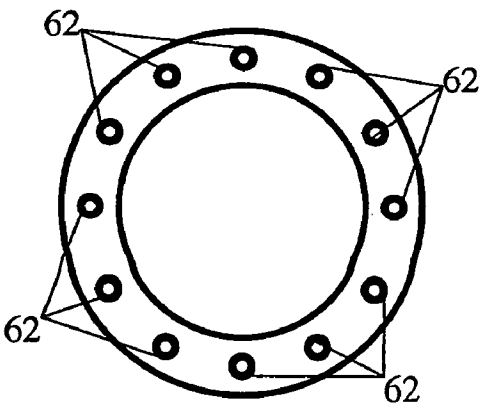
FIG. 5 shows a view seen from underneath in FIG. 4, seen at the level of the section A-A.

FIG. 3 and FIG. 4 show an embodiment of the manner in which addition of the dilution fluid can be realised. The dilution fluid is added by a pump to a distribution chamber 60 that is arranged concentrically around the stand pipe 22. The pump pressurises the fluid to a suitable level, an excess pressure of approximately 0.1-0.8 bar. Alternatively, high-pressure nozzles can be used, which finely distribute the dilution fluid in the form of fanned plumes of fluid, oriented at a suitable angle relative to the vertical, a suitable angle being 30-90°.

A number of nozzles 62 are arranged at the bottom of the distribution chamber oriented obliquely downwards, in the direction of flow of the granulate, and inwards towards the centre of the flow. The amount of obliqueness in the mounting is appropriately 45±15° relative to the vertical. The oblique orientation downwards is favourable for achieving an ejecting influence on the granulate flow, and for avoiding the risk that the dilution fluid splashes upwards in the stand pipe.

A number of nozzles, at least four, are arranged around the stand pipe 22/40', preferably with equal distances between them. With a stand pipe 22 having a diameter of 800-1,500 mm, it is appropriate that 10-40 nozzles are arranged around the periphery of the stand pipe. It is appropriate that the distance between adjacent nozzles be less than 50-300 mm. If high-pressure nozzles with fanned plumes of fluid are used, the nozzles may be arranged with a greater distance between neighbouring nozzles. It is important that the dilution fluid is added evenly around the complete circumference of the flow of granulate and at a sufficiently high pressure in order to penetrate to the centre of the granulate flow. The pressure setting is an engineering adaptation that is based on the nozzles being used, the diameter of the pipe and the rate of flow of fragmented pulp.

Figure 6:
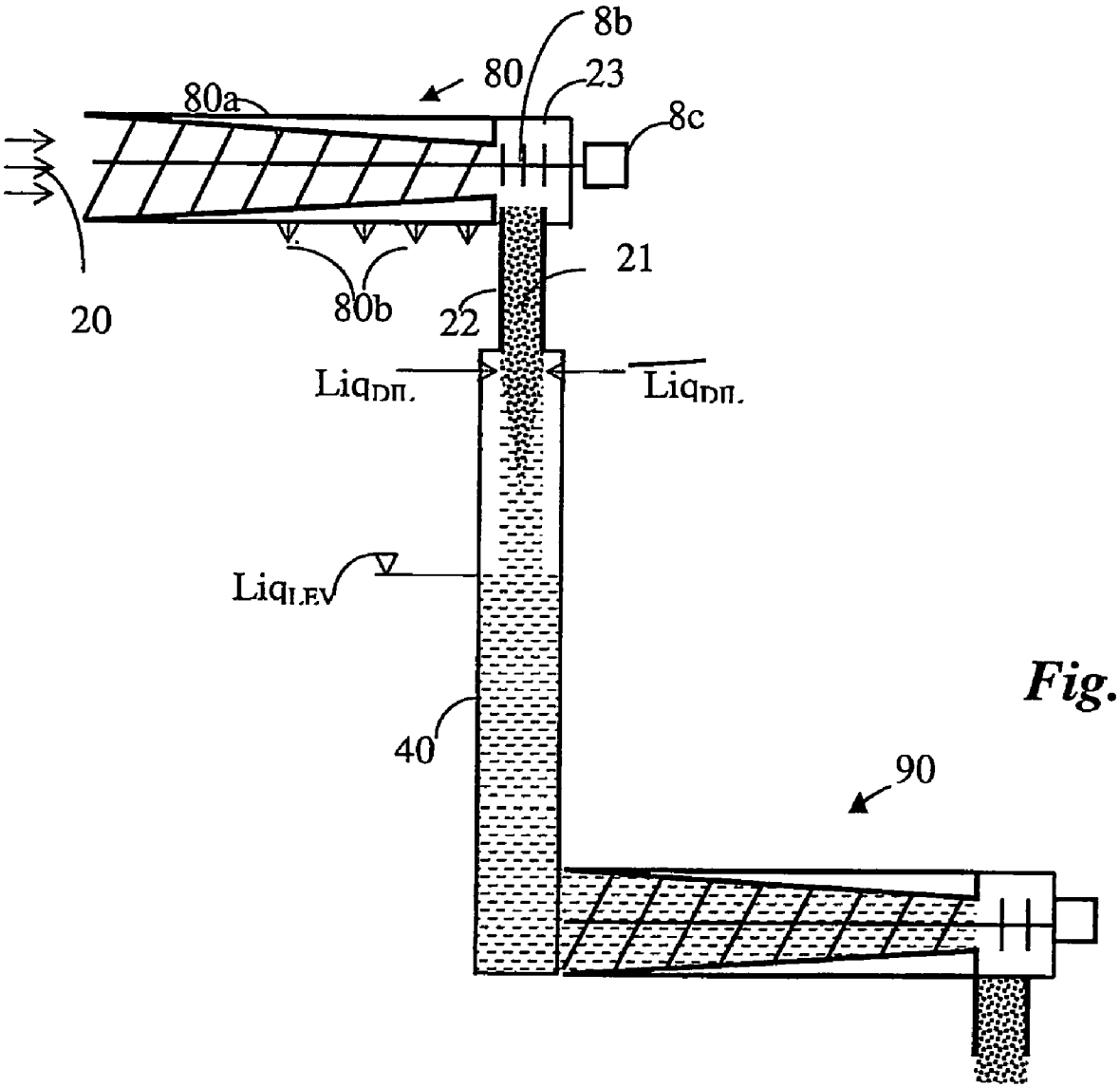
FIG. 6 shows an alternative dilution system according to the invention.

FIG. 6 shows an alternative embodiment of the invention. The difference between the embodiment shown in FIG. 3 and this embodiment is that the dewatering arrangement in this case is a dewatering screw (of Thune type or Sudor type) in which a conical screw 80*a* compresses an incoming flow 20 of pulp during dewatering against a surrounding space through a screwed surrounding perforated housing, and in which filtrate 80*b* is led away from this space. The driving force for the screw is normally located at its inlet, but the motor 8*c* is here shown connected to the outlet of the screw.

The dewatered and compressed pulp that has been consolidated into large pieces is also in this case fed from the outlet of the screw to a simpler fragmentation arrangement in the form of a number of beaters 8*b* that may be located on the same shaft as the conical screw while being located at its outlet. These beaters 8*b* whip and break up the pulp that is fed out from the dewatering screw in the form of dewatered and compressed pulp that has been consolidated into large pieces. It is preferable that these beaters have their own source of power, and that they are driven at a rate of revolution that considerably exceeds the rate of revolution of the screw.

The fragmented flow 21 of pulp particles is subsequently fed by falling under its own weight to the fall 40, in the same manner as that shown in FIG. 3. Furthermore, a second dewatering screw 90 is arranged to receive the diluted pulp suspension at the bottom of the fall 40. The dewatering screw 90 may be another transport arrangement or another distribution arrangement, such as, for example, a distribution screw in the inlet arrangement to a dewatering press.

The dilution otherwise functions in the same manner as in the embodiment shown in FIG. 3, and those parts that are the same have the same reference numerals.

The invention can be modified in a number of ways within the scope of the claims. The nozzle 62 for the addition of dilution fluid may, for example, be constituted by a simple drilled hole in a thick corrugated sheet, with a minimum thickness of 8-10 mm. However, specially adapted nozzles are preferred, which preferably generate a fan-shaped plume of fluid, in order to ensure optimal penetration of the granulate flow and an even distribution over the complete circumference of the flow. Addition of dilution fluid can also take place at a sufficiently high pressure that the dilution fluid more forms a very finely divided mist in the region that the granulated pulp passes.

Addition of dilution fluid takes place in the preferred embodiment in association with an increase in the area of the stand pipe 22 to a lower part 40' of the stand pipe having a larger diameter, but it is not necessary that the addition takes place in association with an increase in area.

A small amount may also be added at the outlet end of the shredder screw, with the addition flow directed down towards the stand pipe. But the dilution is to take place principally through the hydrodynamic mixing effect from the addition of the dilution fluid into the flow of granulate.

While the present invention has been described in accordance with preferred compositions and embodiments, it is to be understood that certain substitutions and alterations may be made thereto without departing from the spirit and scope of the following claims.

The invention claimed is:

1. A method for the dilution of dewatered and compressed cellulose pulp that has been consolidated into large pieces, where the dewatered cellulose pulp maintains a first consistency greater than 20%, comprising: fragmenting the cellulose pulp into a finely divided pulp after or in association with dewatering, thus granulating the cellulose pulp through said fragmentation to a particle size with a normal distribution with a maximum size that is less than 40 mm, while fragmenting, maintaining a consistency of the cellulose pulp that is essentially equivalent to the first consistency, feeding the cellulose pulp that has been finely divided through the fragmentation into a freely falling flow, adding dilution fluid under pressure towards the freely falling fragmented pulp through a number of fluid jets arranged in association with the flow of the freely falling fragmented pulp, the amount of dilution fluid added through the fluid jets establishing a second consistency of the cellulose pulp in a medium-consistency range 8-16%, feeding the cellulose pulp at this medium consistency 8-16% onwardly to subsequent treatment stages, a dilution of the freely falling pulp taking place essentially exclusively under an influence of hydrodynamic effect from the addition of the dilution fluid through the fluid jets, and where no mechanical agitation takes place between the fragmentation of the cellulose pulp and an underlying surface of the cellulose pulp that has been diluted by the dilution fluid.

2. The method according to claim 1, wherein the fluid jets are arranged around the flow of fragmented pulp formed in the free fall, and are directed principally radially inwards towards the flow.

3. The method according to claim 1, wherein the cellulose pulp at medium consistency is fed onwardly to subsequent treatment stages through pumping.

4. The method according to claim 1 wherein the dilution fluid added is added to a degree of more than 50%, through the fluid jets.

5. The method according to claim 4, wherein the fluid jets are directed at an angle of 45°±15° relative to a vertical direction and a fall direction of granulate.

6. The method according to claim 1 wherein the addition of dilution fluid from the fluid jets takes place in a form of pressurized fluid jets that are directed obliquely downwardly in a fall direction of the cellulose pulp.

* * * * *